United States Patent [19]

Asbach

[11] Patent Number: 4,867,723

[45] Date of Patent: Sep. 19, 1989

[54] TOY SIMULATED EXPLODABLE SHACK

[75] Inventor: Ronald M. Asbach, Grand Island, N.Y.

[73] Assignee: The Quaker Oats Company, Chicago, Ill.

[21] Appl. No.: 255,159

[22] Filed: Oct. 11, 1988

[51] Int. Cl.[4] ..... A63H 33/00

[52] U.S. Cl. ..... 446/4; 446/478; 446/430

[58] Field of Search ..... 446/4, 6, 476, 478, 446/487, 423, 477, 431, 430

[56] References Cited

U.S. PATENT DOCUMENTS 2,955,381 10/1960 Joslyn ..... 446/1 X 4,734,076 3/1988 Goldstein et al. ..... 446/4 X

FOREIGN PATENT DOCUMENTS 462460 1/1950 Canada ..... 446/476

*Primary Examiner*—Mickey Yu

*Attorney, Agent, or Firm*—Cumpston & Shaw

[57] ABSTRACT

A toy simulated explodable shack is disclosed that is actuated by a toy car running through the doors thereof. The shack includes a base, and a pair of shack frame members including side walls and doors pivotally mounted on the base for pivotal movement between a closed position, in which the shack frame members come together to form a shack, and an open position in which the shack frame members separate and rest on the side walls thereof. A floor member is mounted on the base onto which a movable hatch member is mounted. A first tensioning spring is provided for tensioning the hatch member to exert a predetermined force. A latch is provided that includes a rear panel on the floor member for releasably holding the hatch member in its tensioned condition. A propelled car strikes and opens the doors, causing the shack frame members to be slammed to their open position. Substantially simultaneously, the car strikes the rear panel releasing the latch, causing the hatch member to catapult the car out of the shack. These actions simulate an exploding shack.

11 Claims, 3 Drawing Sheets

TOY SIMULATED EXPLODABLE SHACK

FIELD OF THE INVENTION

The present invention relates generally to action toys, and more specifically to a toy simulated explodable shack actuated by a toy car propelled through the doors thereof.

1. Background of the Invention

Children tend to spend a considerable amount of their time indulging in the world of fantasy and make-believe. There has been a constant search for years for action toys that can produce a new, more entertaining, and more amusing action.

This invention is a realization of an attempt to make the action of a toy shack, as it virtually explodes before their eyes, more entertaining, interesting and enjoyable.

2. Summary of the Invention

An object of this invention is to provide a toy simulated explodable shack that is actuated by a toy car propelled through the doors thereof. The toy simulated explodable shack comprises:

a base;

a pair of shack frame members each comprising a side wall, a roof wall and a door, is pivotally mounted on the base for pivotal movement between a closed position in which the shack frame members come together to form a shack frame, and an open position in which the shack frame members are separated and rest on the side walls thereof;

a floor member mounted on the base and having a ramp for guiding the car into the shack frame, and having a flexible rear panel;

a movable hatch member mounted on the floor member;

first tensioning means for tensioning the hatch member to exert a predetermined catapulting force; and latch means comprising the rear panel for releasably holding the hatch member in its tensioned position, whereby a propelled car guided by the ramp strikes and opens the doors, slamming the shack frame members to their open position. The car substantially simultaneously strikes the rear panel releasing the latch means, causing the hatch member to catapult the car off the floor member.

Another object of the invention is to provide a toy explodable shack wherein the floor member has a rear wall, and spaced-apart side rails which are engageable by side edges of the doors to prevent movement of the shack frame members to their open position, until the front bumper of the car almost reaches the rear wall. Accordingly, explosive movement of the shack frame members and hatch member occurs substantially simultaneously.

Still another object of the invention is to provide the aforementioned toy explodable shack with a second tensioning means for tensioning the hatch member to exert a catapulting force greater than the predetermined catapulting force exerted by the first tensioning means.

A more specific object of the invention is to provide a toy explodable shack wherein the first tensioning means comprises a spring having one end bearing against the hatch member, and the opposite end bearing against a shoulder in a first position. The second tensioning means comprises a slider mounted on the base, and secured to the shoulder and movable with the shoulder to a second position for further tensioning the spring. Lock means are provided for releasably locking the slider and shoulder in the second position.

Still another object of the invention is to provide a toy explodable shack having stop means for preventing movement of the slider and shoulder to the second position when the shack wall members are in their open position.

BRIEF DESCRIPTION OF THE DRAWINGS

In the detailed description of the invention presented below, reference is made to the accompanying drawings, in which.

DETAILED DESCRIPTION OF A PREFERRED EMBODIMENT

Figure 1:
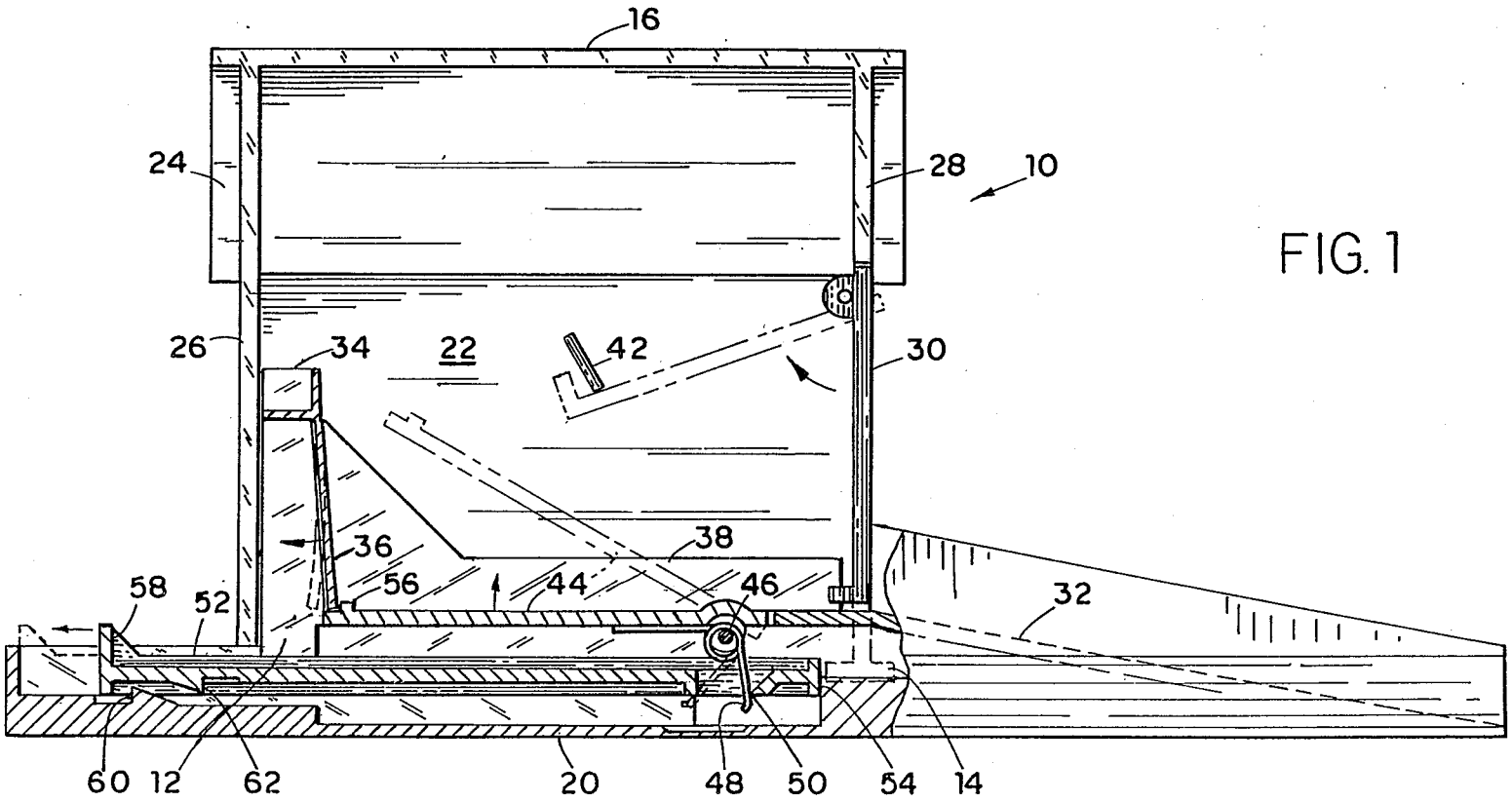
FIG. 1 is a side-elevational view of a preferred embodiment of a toy simulated explodable shack in which one of the shack frame members is omitted for purposes of clarity.
Figure 2:
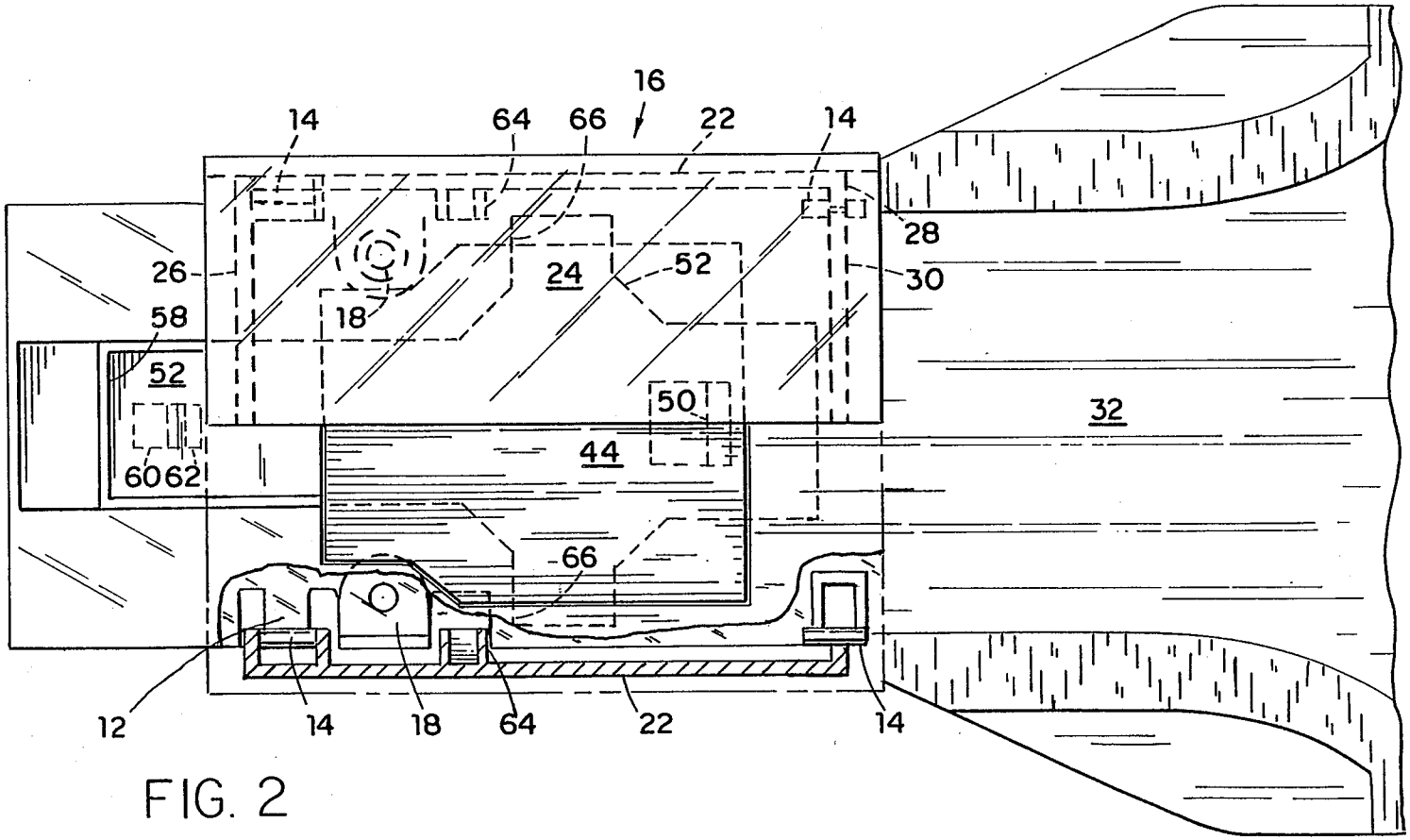
FIG. 2 is a top plan view of the toy simulated explodable shack of FIG. 1.
Figure 3:
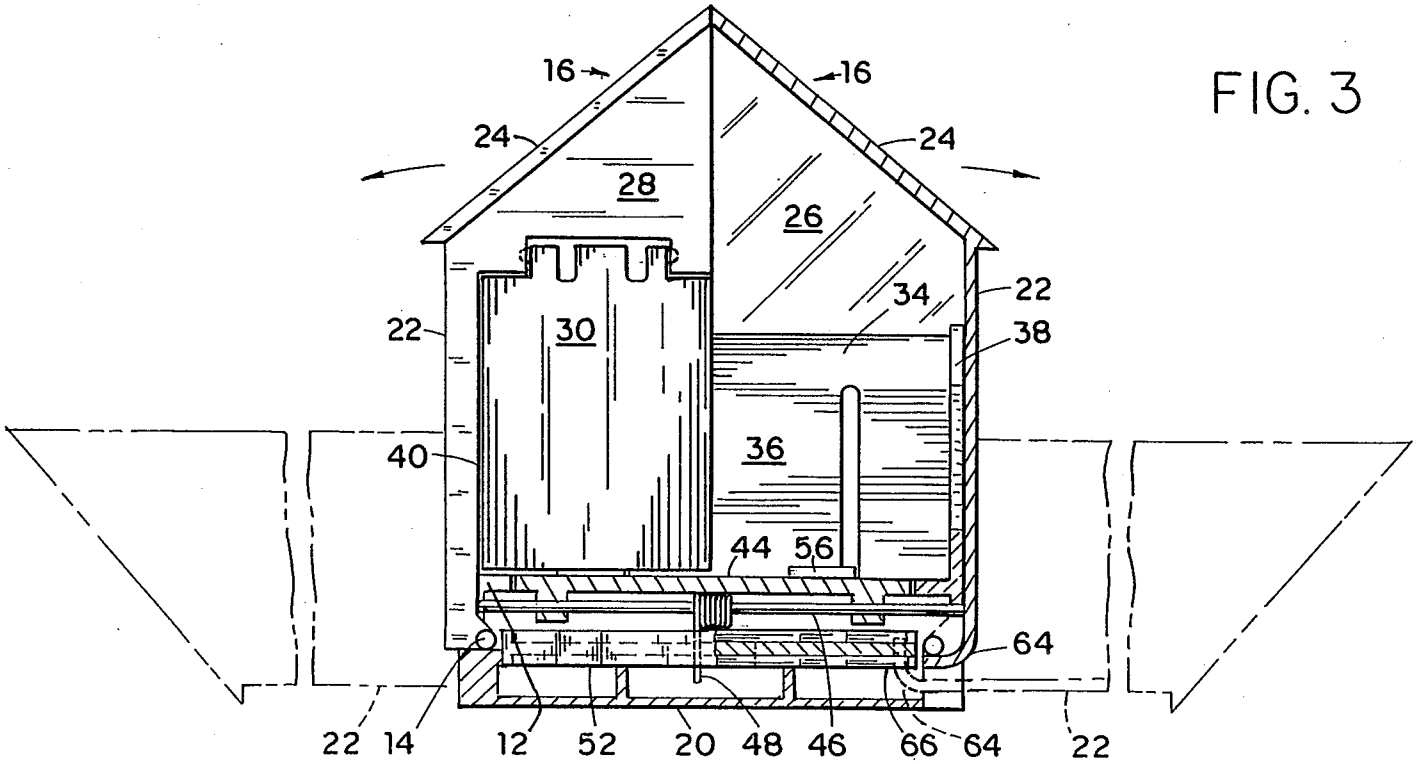
FIG. 3 is a front-elevational view of the toy simulated explodable shack of FIG. 1.

With reference to FIGS. 1–3, a preferred embodiment of a toy simulated explodable shack 10 of this invention is disclosed. The explodable shack comprises a rectangular base member 12 having a pair of spaced recesses on each side, within which hinge pins 14 on a pair of shack frame members 16 nest. The base member 12 further receives a plurality of posts 18 depending from a cover member 20. The cover member is secured to the base member 12 by screws, not shown, extending into or through the base member and into the posts 18. The base member 12 further has recesses engaging the opposite surface of the hinge pins 14, for providing with the aforementioned recesses, a hinge socket for the hinge pins.

Each of the shack frame members 16 is half of a shack, and comprises a side wall 22, a roof wall 24, a rear wall 26, and a front wall 28 which hingeably supports a door 30. The shack frame members 16 are pivotally movable between a closed position in which the shack frame members come together to form a closed shack, and an open position in which the shack frame members separate and rest on the side walls 22 thereof. The base member 12 further has a front ramp 32 for guiding a car into the closed shack, and an end wall 34 having a flexible depending end panel 36. The base member 12 has a pair of spaced-apart side rails 38, which are engaged by side edges 40 of the doors in the closed position to prevent movement of the shack frame members 16 to their open position. Once the doors 30, when struck by a propelled car, swing inwardly a sufficient distance, so that the bottom edges thereof clear the side rails 38, side edges 40 of the doors also strike cam members 42 on the inner surface of side walls 22 for slamming the shack frame members 16 into their open position.

The toy explodable shack 10 is further provided with a hatch member 44, which is pivotally mounted on the base member 12 for catapulting a car that enters the shack out of the shack. The hatch member 44 is substantially rectangular, and has one end thereof mounted for pivotal movement on a shaft 46 journaled in the side rails 38 of the base member 12. A torsion spring 48 encircles the shaft and has one end thereof engaging the under surface of the hatch member 44. The opposite end of the spring engages a shoulder 50 on a slider 52, for biasing the slider into engagement with a stop or lug 54 for positioning the shoulder 50 in a first position. In this position, the spring 48 exerts a catapulting force against the hatch member 44 of a predetermined amount. A latch means is provided for latching the hatch member in its closed position, and comprises a lip 56 on the rear end of the hatch member 44 engageable by the free end of the flexible end panel 36. The predetermined catapulting force generated by the spring 48 is insufficient to be harmful to children in any way. The slider 52 is mounted on the base member 12, and is loosely retained thereon for slidable movement in its closed position. To tension the spring 48 to exert a catapulting force greater than the predetermined force for catapulting a car from the shack 10, the slider 52 is retracted by a rib 58 to a locked position shown in phantom in FIG. 1, causing the slider shoulder 50 to move to a second position shown in phantom in FIG. 1 for further tensioning the spring 48. The lock means for releasably locking the spring and slider 52 in the second position comprises a lip 60 on the base member 12, engageable by a complementary lug 62 on the slider 52.

Stop means are provided for preventing movement of the slider 52 and shoulder 50 to the second position, when the shack frame members 16 are in their open position as shown in phantom on FIG. 5. The stop means comprises a finger 64 on the shack frame member 16 engageable by a laterally extending arm 66 on the slider 52.

In the operation of this invention, when the shack frame members 16 are in the closed position, and a car is propelled up the ramp 32 and through the doors 30 into the shack, the following occurs. The car pivots the doors 30 inwardly until they clear the side rails 38, then strikes the cam member 42 on the inner surface of the roof walls 24 for slamming the shack frame members 16 into their open position. Substantially simultaneously, the front end of the car strikes the end panel 36, releasing the latch means, causing the hatch member 44 to catapult the car out of the shack 10.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy simulated explodable shack actuated by a toy car propelled through the doors thereof comprising:

a base;

a pair of shack frame members each having a side wall, a roof and a door pivotally mounted on the base for pivotal movement between a closed position in which the shack frame members come together to form a shack, and an open position in which the shack frame members are separated and rest on the side walls thereof;

a floor member mounted on the base and having a ramp for guiding a car into the shack, and having a flexible rear panel;

a movable hatch member mounted on the floor member;

first tensioning means for tensioning the hatch member to exert a predetermined catapulting force; and latch means comprising the rear panel for releasably holding the tensioned hatch member, whereby a propelled car guided by the ramp strikes and opens the doors and slams the shack frame members to their open position, and substantially simultaneously strikes the rear panel for releasing the latch means, causing the hatch member to catapult the car out of the shack.

2. A toy explodable shack according to claim 1 wherein the hatch member has a front end and a rear end, and the front end is pivotally secured on the floor member and the rear end comprises a portion of the latch means coupled to the rear panel.

3. A toy explodable shack according to claim 2 wherein the flexible rear panel has one end secured to the floor member, and the opposite end free, and the latch means comprises a lip on the rear end of the hatch member engageable by the free end of the flexible rear panel.

4. A toy explodable shack according to claim 2 wherein the floor member has spaced-apart side rails, which are engageable by the doors to prevent movement of the shack frame members to their open position until the front end of the car almost reaches the rear wall, so that explosive movement of the frame members and hatch member will occur substantially simultaneously.

5. A toy explodable shack according to claim 4 wherein the roof member of the shack frame member is provided with a cam member on the inner surface thereof, which is engageable by a door as the door is swung inwardly for slamming the shack frame members to their open position.

6. A toy explodable shack according to claim 1, and further comprising second tensioning means for tensioning the hatch member to exert a catapulting force greater than the predetermined catapulting force.

7. A toy explodable shack according to claim 6 wherein the first tensioning means comprises a spring having one end bearing against the hatch member, and the opposite end bearing against a shoulder in a first position, and said second tensioning means comprises a slider mounted on the base and secured to the shoulder and movable with the shoulder to a second position for further tensioning the spring, and lock means for releasably locking the slider and shoulder in the second position.

8. A toy explodable shack according to claim 7 wherein the lock means comprises a lip on the base engageable by a lug on the slider.

9. A toy explodable shack according to claim 7, and further comprising stop means for preventing movement of the slider and shoulder to the second position, when the shack frame members are in their open position.

10. A toy explodable shack according to claim 9 wherein the stop means comprises a finger on a shack frame member engageable by a laterally extending arm on the slider to prevent movement of the slider to the second position.

11. A toy explodable shack according to claim 10 wherein said finger engages and releases the slider from said second position when said shack frame member is pivotally moved out of the closed position.

* * * * *